US012035855B2

(12) United States Patent
Limbert

(10) Patent No.: US 12,035,855 B2
(45) Date of Patent: Jul. 16, 2024

(54) LIQUID SUPPLY SYSTEM

(71) Applicant: Deb IP Limited, Derbyshire (GB)

(72) Inventor: Dean Limbert, Derbyshire (GB)

(73) Assignee: DEB IP LIMITED, Derbyshire (GB)

( * ) Notice: Subject to any disclaimer, the term of this patent is extended or adjusted under 35 U.S.C. 154(b) by 0 days.

(21) Appl. No.: 17/628,248

(22) PCT Filed: Jul. 17, 2020

(86) PCT No.: PCT/GB2020/051714
§ 371 (c)(1),
(2) Date: Jan. 19, 2022

(87) PCT Pub. No.: WO2021/014128
PCT Pub. Date: Jan. 28, 2021

(65) Prior Publication Data

US 2022/0257068 A1 Aug. 18, 2022

(30) Foreign Application Priority Data

Jul. 19, 2019 (GB) ..... 1910415

(51) Int. Cl.
*A47K 5/12* (2006.01)

(52) U.S. Cl.
CPC ..... *A47K 5/1217* (2013.01); *A47K 5/1202* (2013.01); *A47K 2005/1218* (2013.01)

(58) Field of Classification Search
CPC ..... A47K 5/1217; A47K 5/1202; A47K 2005/1218; A47K 5/14; A47L 15/4418; E03C 1/046
See application file for complete search history.

(56) References Cited

U.S. PATENT DOCUMENTS 5,758,761 A * 6/1998 Selbertinger ..... B65G 45/02 198/500
6,230,939 B1 * 5/2001 Willeke ..... G07F 13/025 222/173
9,546,474 B2 * 1/2017 Cochart ..... E03C 1/046
2004/0236522 A1 * 11/2004 Howes, Jr. ..... A47L 15/0063 702/31

(Continued)

FOREIGN PATENT DOCUMENTS

CN 1228365 A * 9/1999 ..... B05B 3/1014
EP 0913356 A1 5/1999

(Continued)

OTHER PUBLICATIONS

International Search Report and Written Opinion for PCT/GB2020/051714, dated Oct. 26, 2020 (9 pages).
Search Report for GB1910415.7, dated Jan. 24, 2020 (4 pages).

*Primary Examiner* — Bob Zadeh
(74) *Attorney, Agent, or Firm* — Quarles & Brady LLP

(57) ABSTRACT

A liquid supply system for supplying liquid to one or more liquid dispensers is provided. The system comprises a water source for supply of water to the system; a concentrate reservoir for supply of concentrate to the system; and a liquid reservoir coupled to the water source and the concentrate reservoir, and configured to be coupled to one or more liquid dispensers. In use, the liquid reservoir is configured to supply liquid to the or each dispenser and is replenished via the water source and concentrate reservoir.

18 Claims, 6 Drawing Sheets

(56) References Cited

U.S. PATENT DOCUMENTS

2005/0133100 A1* 6/2005 Bolderheij ..... E03C 1/0404 137/801
2007/0044819 A1* 3/2007 Chan ..... D06F 39/022 134/18
2009/0000024 A1* 1/2009 Louis ..... E03C 1/046 222/1
2011/0027148 A1* 2/2011 Zlatic ..... E03C 1/046 222/630
2011/0192433 A1* 8/2011 Harris ..... B01F 35/832 134/123
2014/0001054 A1* 1/2014 Longhenry ..... A47L 11/4083 204/232
2014/0057003 A1* 2/2014 Johnson ..... C02F 1/4618 204/263
2014/0143948 A1* 5/2014 Cochart ..... E03C 1/046 4/676
2014/0259382 A1* 9/2014 Dobizl ..... E03C 1/046 4/677
2017/0044747 A1* 2/2017 Louis ..... E03C 1/046
2022/0257068 A1* 8/2022 Limbert ..... A47K 5/1202

FOREIGN PATENT DOCUMENTS

EP 2540584 A2 * 1/2013 ..... B60S 1/50
JP H07112799 * 5/1995
JP H084067 A * 1/1996
JP H084067 A 1/1996
JP H09290368 * 11/1997
JP 2007175275 A * 7/2007
JP 2007175275 A 7/2007
JP 2017079948 A 5/2017
TW 200627108 A 8/2006
WO WO-2012103010 A1 * 8/2012 ..... A61L 9/22

* cited by examiner

LIQUID SUPPLY SYSTEM

CROSS REFERENCE TO RELATED APPLICATIONS

The present application represents the United States National Stage of International Application No. PCT/GB2020/051714, filed Jul. 17, 2020, which claims priority to Great Britain Patent Serial No. 1910415.7, filed on Jul. 19, 2019, which are incorporated by reference in their entireties herein.

FIELD OF THE INVENTION

The present disclosure relates to a liquid supply system for supplying liquid to one or more liquid dispensers.

BACKGROUND OF THE INVENTION

Liquid dispensers, e.g. soap dispensers, are often provided in washrooms, kitchens and other public facilities. Dispensers can be wall mounted or counter mounted and typically are supplied with liquid e.g. soap from a reservoir.

As the dispensers are used the amount of soap in the reservoir is depleted and so needs to be replenished. In some systems, the reservoir is open and can be refilled by pouring in additional soap from a separate vessel. Such systems can be unhygienic due to the open nature of the reservoir.

In other systems, the reservoir is a collapsible cartridge which can be replaced with a new cartridge as and when required. Although these are generally considered to be more hygienic, in practice, the collapsible cartridges are often replaced before being completely empty. A significant drawback of such a cartridge-based system is therefore liquid wastage arising from refilling prior to the currently installed cartridge becoming fully depleted. Time to depletion is generally unknown and unpredictable. Refilling at the point of depletion may not be convenient, particularly as the liquid dispenser is then rendered temporarily, and depending on the application potentially unacceptably, unusable pending replacement of the cartridge. Liquid dispensers tend to be refilled during nightly shifts by janitors or other service providers. Thus the temptation is to set the refilling frequency and container volume such that during ordinary or even heavy use the liquid dispensers will never become depleted and rendered temporarily out of action. But replacing a cartridge prior to depletion of that cartridge undesirably results in liquid wastage. This not only leads to increased costs, but unnecessary disposal or wastage which is out of keeping with the desire to promote reduced impact to the environment, otherwise known as being environmentally friendly.

In another system, a main reservoir and an auxiliary reservoir are arranged to supply liquid to a dispenser. The use of both the main and auxiliary reservoirs allows the main reservoir to be replaced when empty without affecting the supply of liquid to the end user, as the auxiliary reservoir continues supplying additional liquid to the user. A drawback of this system is that is requires replacement of a relatively large reservoir of liquid. Transporting such large volumes of liquid can be is costly and has environmental impacts. It can also be time consuming and cumbersome for wash room operatives.

In any of the above systems, refilling or replacing the reservoir or replacing the cartridge in a counter mounted dispensing system is often ergonomically challenging as access to the reservoir or cartridge below the counter is often restricted. Janitorial staff will often have to remove access panels or lie on the floor below the counter to be able to replace the spent cartridge or refill the reservoir.

Accordingly, the present disclosure seeks to overcome or at least mitigate the problems of the prior art.

SUMMARY OF THE INVENTION

In a first aspect, a liquid supply system is provided for supplying liquid to one or more liquid dispensers, the system comprising:

a. a water source for supply of water to the system;
b. a concentrate reservoir for supply of concentrate to the system; and
c. a liquid reservoir coupled to the water source and the concentrate reservoir, and configured to be coupled to one or more liquid dispensers;

wherein, in use, the liquid reservoir is configured to supply liquid to the or each dispenser and is replenished via the water source and concentrate reservoir.

Water from the water source and concentrate from the concentrate reservoir are mixed in the system to produce a liquid. For example, the concentrate may be a soap concentrate and the liquid may be a soap (i.e. diluted soap concentrate). As used herein, the term "soap" is intended to include any liquid detergent or cleaning product suitable for being dispensed from a liquid dispenser.

The liquid reservoir is coupled to the water source and the concentrate reservoir such that the liquid reservoir can be filled with liquid (e.g. diluted concentrate), mixed either in the liquid reservoir itself or elsewhere in the system e.g. prior to reaching the liquid reservoir. Liquid from the liquid reservoir can then be supplied to the one or more liquid dispensers as and when required by a user. In this way, in-situ dilution of the concentrate is provided.

In some embodiments, the liquid in the liquid reservoir is formed by mixing concentrate with water. Since mixing of the concentrate and water takes place prior to the liquid arriving at the dispenser, the dispenser itself is not required to mix the concentrate and water. Any suitable type of dispenser can therefore be used. In this way, a more flexible system is provided.

Liquid dispensers release a liquid upon user activation. Various configurations of liquid dispensers exist. The liquid can be dispensed in a discrete or continuous fashion. The liquids being dispensed can be soap, shampoo, other hand sanitizer or lotion, cleaning agents, etc. Liquid dispensers can be manual, e.g. operator pushes a lever, or can be automatic, e.g. activated upon motion detection. The applications of liquid dispensers are numerous and include soap dispensing in bathrooms, soap or shampoo dispensing in showers and baths, sanitizing dispensers for use in operating theatres or treatment rooms, sanitization facilities for factories, school dining halls, etc. Liquid dispensers may employ anti-bacterial soap and are often used for hygienic and infection fighting purposes.

Liquid dispensers can be wall mounted and can be judiciously situated to conveniently serve a number of operators for sanitization in key locations such as prior to entry to the dining hall, in the toilet, at the entry to and within a patient room, or prior to operating in the operating theatre.

The liquid dispensers may be arranged to dispense the liquid in any suitable form, e.g. as a liquid, foam, spray, or any other suitable form.

Advantageously, use of a foam dispenser enables a thinner liquid (i.e. less viscous liquid to be used). A liquid of lower viscosity will flow more easily through the system, reducing the likelihood of pipes becoming clogged. This lower viscosity liquid can then be foamed as it is dispensed, providing the user with a more acceptable dispensed product.

In the system disclosed herein, the arrangement of the liquid supply system having a water supply and a concentrate supply enables the liquid reservoir to be refilled or replenished with liquid as required. In other words, liquid from the liquid reservoir is depleted by use of the dispensers, and the liquid reservoir is automatically replenished with liquid provided by mixing water from the water supply with concentrate from the concentrate reservoir.

No separate refilling activity of the liquid reservoir is required e.g. by a janitor. Instead, the system automatically replenishes the liquid reservoir with liquid for dispensing to a user. There is no need to disconnect the liquid reservoir from the dispensers and move it to another location for refill e.g. a refill station. There is also no need to carry or transport a refill device or a replacement liquid reservoir e.g. a cartridge, to the location of the liquid reservoir. Therefore, supply of replacement diluted liquid is not required.

In this way, the need to provide a predominantly water based product to the location of the liquid reservoir is avoided. Accordingly the environmental impact of such transporting and shipping over long distances, from manufacturing plant to end use point, is avoided. This is achievable because no pre-mixing of diluted concentrate for refilling the liquid reservoir is required. In contrast the system enables concentrate and water to be mixed by the system itself to replenish the liquid reservoir.

Since the liquid reservoir can be refilled in situ, a liquid reservoir having a larger volume is possible. Accordingly a single liquid reservoir can service an increased number of liquid dispensers. On the other hand, since the liquid reservoir is automatically refilled by the system, a liquid reservoir having a smaller volume can be used. This provides a flexible system in which the volume of the liquid reservoir can be selected as appropriate for the space available and in view of the frequency of use of the liquid dispensers.

In exemplary embodiments, the volume of the liquid reservoir can be 250 ml or less. In exemplary embodiments, the volume of the liquid reservoir can be between 250 ml and 1 litre, e.g. 500 ml, e.g. 750 ml. In exemplary embodiments, the volume of the liquid reservoir can be 1 litre or more, e.g. 1, 1.5, 2, 3, 5, 10, 20, 30, 40 or 50 litres. In exemplary embodiments, the volume of the liquid reservoir can be greater than 50 litres. In exemplary embodiments, the volume of the liquid reservoir can be any suitable volume.

When the concentrate reservoir is depleted, it can be replaced or refilled. Since the liquid reservoir is automatically refilled, even when the concentrate reservoir is depleted, there will still be a supply of liquid in the liquid reservoir which can be provided to the dispensers on demand. Therefore there is no interruption in the supply of liquid to the dispensers. Liquid is always available because the liquid reservoir is topped up or refilled as required.

In the system disclosed herein, it is only the concentrate reservoir that will need replacing or refilling when depleted. As compared to a reservoir of diluted concentrate having a similar volume, the concentrate reservoir will require replacing less often and therefore the impact of any ergonomic restrictions in refilling or replacing the concentrate reservoir is reduced.

Further, the concentrate reservoir can be relatively small in volume since it contains concentrated liquid, therefore it is easier to transport. This greatly reduces the environmental impact associated with transporting liquid for liquid dispensing. In particular, use of replaceable concentrate reservoirs removes the need to transport a "ready-to-use" liquid (e.g. a diluted soap), which includes a large component of water, and therefore reduces the time, cost and environmental impact of this.

In addition, the relatively small volume of the concentrate reservoir means that it is more easily carried around by an operative and more conveniently stored. For example, multiple replacement concentrate reservoirs may be carried around by an operative, e.g. on a trolley, meaning that fewer trips to a storage area must be undertaken on a liquid dispenser refilling round. Such a configuration is low-complexity and as such, could reduce operating costs.

Since the liquid reservoir is automatically refilled or replenished by the system, and only the concentrate reservoir requires refilling or replacing, the liquid reservoir does not need to be open to allow refill. This removes or reduces problems of hygiene which can be incurred when the reservoir is open.

Optionally, the liquid reservoir is fixed, directly or indirectly, to the water source.

In other words, the liquid reservoir is plumbed in to the water source. Put another way, the liquid reservoir is fastened securely to the water source. In this way a continuous supply of water is provided. There is no need to move the liquid reservoir from its position in order to introduce water. Similarly there is no requirement to transport water to the liquid reservoir for refill. Advantageously, this allows the liquid reservoir to be refilled when required from a standard water outlet.

Optionally, the liquid reservoir is configured to be fixed, directly or indirectly, to the or each liquid dispenser.

In other words, the liquid reservoir is configured to be fastened securely to the or each liquid dispenser when in use. This ensures a continuous supply of liquid from the liquid reservoir to the or each liquid dispenser. Even when the concentrate reservoir is depleted, liquid will still be supplied from the liquid reservoir until the concentrate is replaced. Accordingly, in normal use, there will be no interruption in supply to the or each liquid dispenser.

Optionally, the liquid reservoir is provided in a given location in which it is configured to supply liquid to the or each liquid dispenser, wherein the system is configured such that the liquid reservoir remains in said given location as it is replenished.

In other words, the liquid reservoir is not removed from its position in order to refill. This ensures that a continuous supply of liquid to the dispensers is provided.

Optionally, the system comprises a sensor configured to detect a fill level condition of the liquid reservoir, wherein the system is configured to replenish the liquid reservoir in response to feedback from the sensor.

In this way, the liquid reservoir is replenished as and when required, according to feedback from the sensor.

Optionally, the sensor is configured to detect when the liquid reservoir is empty, when an amount of liquid in the liquid reservoir is below a predetermined minimum fill level, when the amount of liquid in the liquid reservoir has reached a predetermined maximum fill level, and/or when the liquid reservoir is full.

In exemplary embodiments, the sensor is configured to detect when an amount of liquid in the liquid reservoir is below a predetermined minimum fill level. In some embodiments the predetermined fill level corresponds to a level above an outlet for supplying liquid to the or each dispenser. In this way, air does not enter the outlet, even when the level of liquid in the liquid reservoir is at its lowest level.

Optionally, the sensor is configured to detect when the liquid reservoir is empty or when the amount of liquid in the liquid reservoir is below a predetermined minimum amount, wherein the system is configured such that replenishing of the liquid reservoir via the water source and concentrate reservoir is triggered when the sensor detects that the liquid reservoir is empty or when the amount of liquid in the liquid reservoir is below the predetermined minimum amount.

In this way, the liquid reservoir is replenished when it is empty or when the amount of liquid left in the liquid reservoir is low. This ensures the availability of liquid to the dispensers.

Optionally, the sensor is configured to detect when the liquid reservoir is full or when the amount of liquid in the liquid reservoir has reached the or a predetermined maximum amount, wherein the system is configured such that replenishing of the liquid reservoir via the water source and concentrate reservoir is stopped when the sensor detects that the liquid reservoir is full or when the amount of liquid in the liquid reservoir has reached the predetermined maximum amount.

In this way, overfilling of the liquid reservoir is avoided.

Optionally, the sensor comprises a pressure sensor, a fill level switch and/or a float switch.

In exemplary embodiments, any suitable sensor or combination of sensors can be used.

Optionally, the sensor comprises a plurality of sensors.

For example, the system may comprise a first sensor for detecting that the liquid reservoir is empty and a second sensor for detecting when the liquid reservoir is full. For example the system may comprise a first sensor configured to detect when an amount of liquid in the liquid reservoir is below the predetermined minimum amount, and a second sensor configured to detect when an amount of liquid in the liquid reservoir has reached the predetermined maximum amount. Any suitable combination of sensors can be used, as will be appreciated. For example, any suitable combination of sensors can be used to ensure that the liquid reservoir is refilled when required and is not overfilled with liquid.

Optionally, the liquid reservoir comprises:

a. at least one inlet, via which the liquid reservoir is replenished, and
b. at least one outlet for supplying liquid to the or each dispenser.

In this way simultaneous dispensing from the liquid reservoir and refilling of the liquid reservoir is permitted. Accordingly there is no interruption in supply of liquid to the liquid dispensers.

Optionally, the liquid reservoir comprises a single inlet coupled to both the concentrate reservoir and the water source.

For example the water from the water source and concentrate from the concentrate reservoir can be mixed prior to entering the liquid reservoir or as they enter the liquid reservoir.

In some embodiments, the inlet of the liquid reservoir is coupled to the water source via a supply line and the concentrate reservoir is coupled to the supply line. In some embodiments, the concentrate from the concentrate reservoir may be introduced into a flow of water in the supply line. Turbulent movement of the water in the supply line may cause the concentrate to mix with the water, diluting the concentrate. Mixing of the concentrate with water passing through the supply line is therefore automatic, and advantageously does not require additional complex (e.g. mechanical) mixing apparatus.

Optionally, the inlet of the liquid reservoir is coupled to the water source via a supply line, and the concentrate reservoir is coupled to the supply line via a dosing mechanism, wherein the dosing mechanism is configured to supply an amount of concentrate from the concentrate reservoir to the supply line.

This ensures that a suitable amount of concentrate is supplied for mixing with the water supplied. In some examples, the concentrate and water mix, at least to some extent, in the supply line. The dosing mechanism may be configured to control the extent of dilution of the concentrate with water in the supply line. This ensures that the liquid reservoir is refilled with a solution of a desired concentration. Advantageously, it can be ensured that said concentration is not too high, which could result in wastage of concentrate and increased costs. It can also be ensured that said concentration is not too low, which could result in a solution being dispensed from the liquid dispenser that is ineffective in killing pathogens.

In some embodiments, concentrate and water are mixed in a ratio of between 1:20 and 1:5, concentrate:water. For example, between 1:15 and 1:5, for example 1:9.

In some embodiments, concentrate and water are mixed in a ratio of between 1:300 and 1:2, concentrate:water. For example, 1:4, 1:8, 1:16, 1:32, 1:64, 1:128, 1:256, concentrate:water.

In some embodiments, the liquid reservoir comprises a plurality of inlets. For example, the liquid reservoir may comprise a first water inlet and a second soap concentrate inlet, wherein said inlets are separate and distinct from each other.

Optionally, the liquid reservoir is fixed, directly or indirectly, to the supply line.

In other words, the liquid reservoir is fastened securely to the supply line.

Optionally, the dosing mechanism comprises a venturi element.

In this way, flow along the supply line draws concentrate from the concentrate reservoir into the supply line.

Optionally, the dosing mechanism comprises a rotary dosing pump.

Optionally, the supply line comprises a pump for controlling the flow through the supply line.

This is particularly beneficial where a venturi element is used in order to ensure sufficient flow through the supply line.

Optionally, the system comprises a first concentrate reservoir and a second concentrate reservoir, wherein the system is configured such that the liquid reservoir can be in fluid communication with either the first concentrate reservoir or the second concentrate reservoir, such that supply of concentrate to the system can be from either the first or second concentrate reservoir.

In other words, supply of concentrate can be from either the first or second concentrate reservoir. The first and second concentrate reservoirs are interchangeably in fluid communication with the liquid reservoir so that supply of concentrate can be switched between the two.

In exemplary embodiments, the system comprises more than two concentrate reservoirs. For example, the system may comprise 3, 4, 5, 6, 7, 8 or more concentrate reservoirs.

In exemplary embodiments, the system may comprise a single concentrate reservoir.

Optionally, the system comprises a control mechanism configured to determine when the concentrate reservoir supplying the liquid reservoir becomes depleted, and to switch supply of concentrate to the other concentrate reservoir.

For example, when the liquid reservoir is in fluid communication with the first concentrate reservoir, the control mechanism detects when the first concentrate reservoir becomes depleted, e.g. empty. The control mechanism then switches supply of concentrate to the second concentrate reservoir. In doing so, the system is configured such that the second concentrate reservoir is in fluid communication with the liquid reservoir. This facilitates an uninterrupted supply of concentrate to the liquid reservoir. Further, there is no need to replace a concentrate reservoir or cartridge until it is completely empty, since the system is unlikely to run out of concentrate. This reduces waste and will have the effect of reducing the number of replacement concentrate reservoirs or refills required.

In exemplary embodiments, in the case of a system including a single concentrate reservoir, the system comprises a control mechanism configured to determine when the concentrate reservoir is depleted. The system may be configured to halt replenishment of the liquid reservoir, when the concentrate reservoir is depleted, until the concentrate reservoir has been replaced or refilled.

In exemplary embodiments, in the case of a system including a plurality of concentrate reservoirs, the system comprises a control mechanism configured to determine when all the concentrate reservoirs are depleted. The system may be configured to halt replenishment of the liquid reservoir, when all the concentrate reservoirs are depleted, until at least one of the concentrate reservoirs has been replaced or refilled.

In exemplary embodiments, the system includes a header tank configured to supply liquid to the or each dispenser when required. The header tank may be provided between the dispenser(s) and the liquid reservoir. For example, this may be advantageous when the liquid reservoir is being replenished, and/or when replenishment of the liquid reservoir has been halted (e.g. awaiting refill or replacement of the concentrate reservoir) and the level of liquid in the liquid reservoir is below the predetermined minimum amount.

Optionally, the water source is a mains water supply.

Optionally, the liquid reservoir is collapsible or is of a rigid construction.

Optionally, the system is airtight.

For example, where the liquid reservoir is collapsible, the system may also be airtight. This reduces the likelihood of any issues of hygiene and contamination.

Optionally, the system is configured to replenish the liquid reservoir via batch filling or continuous filling.

For example, in batch refilling, the liquid reservoir may be allowed to deplete by a predetermined amount before it is then replenished. For example in continuous refilling, the liquid reservoir may be replenished continuously as it is depleted by use of the liquid dispensers.

Optionally, the system includes one or more liquid dispensers coupled to the liquid reservoir.

The liquid dispensers may be through the counter or wall-mounted dispensers.

In an aspect of the disclosure, a soap supply system is provided for supplying soap to one or more dispensers, the system comprising:

a. a water source for supply of water to the system;

b. a soap concentrate reservoir for supply of soap concentrate to the system; and c. a soap reservoir coupled to the water source and the concentrate reservoir, and configured to be coupled to one or more soap dispensers;

wherein, in use, the soap reservoir is configured to supply soap to the or each dispenser and is replenished via the water source and soap concentrate reservoir.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments disclosed herein will now be described, by way of example only, with reference to the accompanying drawings, in which.

DETAILED DESCRIPTION

Figure 1:
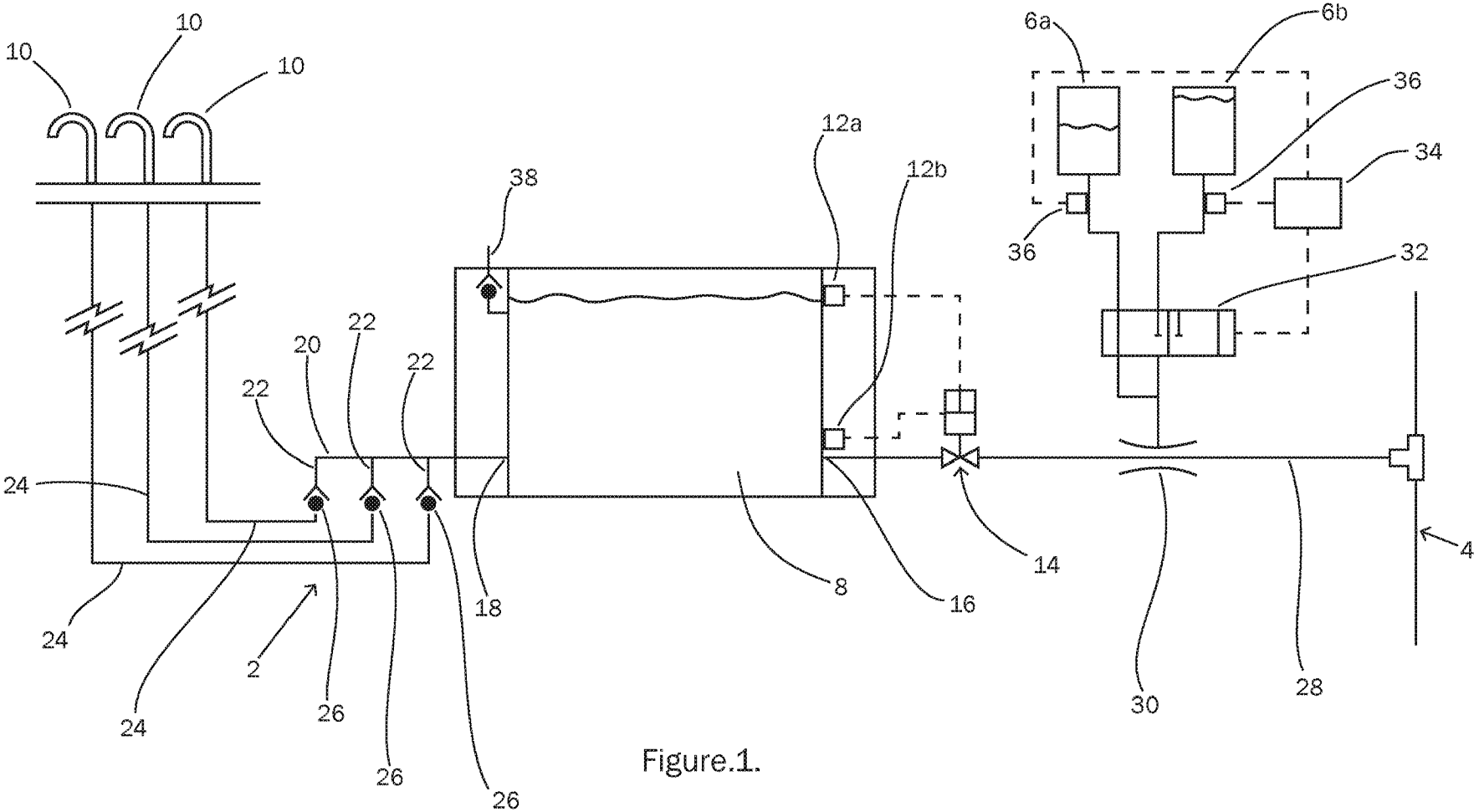
FIG. 1 is a schematic diagram of a liquid supply system in accordance with a first embodiment.

With reference to FIG. 1 there is shown a liquid supply system, e.g. a soap supply system, indicated generally at 2. The system includes a water source 4 which is arranged to supply water to the system, and two concentrate reservoirs, e.g. soap concentrate reservoirs 6*a*, 6*b* for supplying concentrate e.g. soap concentrate to the system.

The system 2 also includes a liquid reservoir, e.g. a soap reservoir 8 which is coupled to the water source 4 and the soap concentrate reservoirs 6*a*, 6*b*, as is shown in FIG. 1. The soap reservoir 8 is coupled to a series of liquid dispensers, e.g. soap dispensers 10. In use, the soap reservoir 8 is configured to supply liquid, e.g. soap to the dispensers 10. Further, the soap reservoir 8 is replenished with soap via the water source 4 and the soap concentrate reservoirs 6*a*, 6*b*.

In the Figures, fluid flow lines are shown with solid lines, and information communication lines are shown with dashed lines.

The soap reservoir 8 is plumbed into the water source 4. In other words, the soap reservoir 8 is fixed to the water source 4, such that the soap reservoir 8 cannot be readily disconnected from the water source 4.

Similarly, the soap reservoir 8 is fixed to the series of soap dispensers 10. In other words, the soap reservoir 8 is coupled to the soap dispensers 10 such that the soap dispensers 10 and soap reservoir 8 cannot be readily disconnected.

The soap reservoir 8 is configured such that it remains in position both during dispensing of soap to the soap dispensers 10 and also during replenishing of the soap reservoir 8 via the water source 4 and the soap concentrate reservoirs 6*a*, 6*b*.

The soap reservoir 8 includes an inlet 16, via which the soap reservoir 8 is replenished, and an outlet 18, for supplying soap to the dispensers 10.

The outlet 18 is coupled to the series of soap dispensers 10 via a manifold 20, which includes a dedicated outlet 22 coupled to each of the dispensers 10 via a respective supply line 24. Each of the supply lines 24 includes a non-return valve 26 to prevent backwash into the soap reservoir 8. In some embodiments, a single outlet is provided from the manifold, this outlet splitting downstream into a series of dedicated supply lines 24 corresponding to each dispenser 10.

The inlet 16 of the soap reservoir 8 is coupled to the water source 4 via a further supply line 28. The soap concentrate reservoirs 6*a*, 6*b* are coupled to the supply line 28 via a dosing mechanism 30. The dosing mechanism 30 is arranged to supply an amount of soap concentrate from the soap concentrate reservoirs 6*a*, 6*b* to the supply line 28. In this way, soap concentrate is added to the water supply to produce diluted soap for replenishing the soap reservoir 8.

The soap reservoir 8 is fixed to the supply line such that the supply line is not readily releasable or removable from the reservoir 8.

The soap supply system 2 includes a sensor configured to detect a fill level condition of the soap reservoir 8. The system 2 is configured to replenish the soap reservoir 8 in response to feedback from the sensor.

In the embodiment illustrated in FIG. 1, the system includes a first sensor 12*a*, a second sensor 12*b* and a valve 14, e.g. an actuated valve. In exemplary embodiments the valve 14 may be a motorised valve, a solenoid valve, a magnetically actuated valve, or any other suitable valve. In the illustrated embodiments, the valve is a piston operated solenoid valve 14. With reference to FIG. 1, the piston operated valve is coupled to each of the sensors 12*a*, 12*b*. The piston operated solenoid valve 14 is configured to permit and prevent flow through the supply line 28.

The first sensor 12*a* is configured to detect when an amount of soap in the soap reservoir 8 has reached a predetermined maximum amount. In some embodiments, the first sensor 12*a* is configured to detect when the soap reservoir 8 is full.

When this predetermined maximum amount has been reached, the system 2 ceases replenishing of the soap reservoir 8. When the first sensor 12*a* detects that the amount of soap in the soap reservoir 8 has reached the predetermined maximum amount the piston operated solenoid valve 14 closes to stop flow through the supply line 28 and prevent further filling of the soap reservoir 8.

The second sensor 12*b* is configured to detect when an amount of soap in the soap reservoir 8 is below a predetermined minimum amount. In some embodiments, the second sensor 12*b* is configured to detect when the soap reservoir 8 is empty.

As illustrated in FIG. 1, the second sensor 12*b* is positioned above (i.e. vertically above) the position of the outlet 18. In this way, under normal operation, the level of soap in the soap reservoir 8 remains above the position of the outlet 18. This reduces the likelihood of air entering the manifold 20 and supply lines 22, 24 to the dispensers 10.

When the second sensor 12*b* detects that the amount of soap in the soap reservoir 8 is below the predetermined minimum amount, the piston operated solenoid valve 14 is opened to permit flow in the supply line 28 and allow replenishing of the soap reservoir 8.

In the embodiment illustrated in FIG. 1, the dosing mechanism comprises a venturi element. As water flows through the supply line 28, through the venturi element 30, soap concentrate is drawn into the supply lines from one of the soap concentrate reservoirs 6*a*, 6*b*.

As previously described, the system 2 includes two soap concentrate reservoirs 6*a*, 6*b*. These are coupled to the supply line 28 via a switch manifold 32. The switch manifold 32 is operable between a first position and a second position. In the first position, the first soap concentrate reservoir 6*a* is in fluid communication with the soap reservoir 8 and the second soap concentrate reservoir 6*b* is disconnected from the soap reservoir 8. In the second position the second soap concentrate reservoir 6*b* is in fluid communication with the soap reservoir 8 and the first soap concentrate reservoir 6*a* is disconnected from the soap reservoir 8. In this way, supply of soap concentrate to the supply line 28 can be switched between the first and second soap concentrate reservoirs 6*a*, 6*b*. FIG. 1 shows the switch manifold 32 in the first position.

It will be appreciated that in some embodiments, the system comprises more than two concentrate reservoirs coupled to the supply line via the switch manifold. For example, the system may comprise 3, 4, 5, 6, 7, 8 or more concentrate reservoirs.

The system 2 also includes a control mechanism 34 which is configured to determine when either of the first and second soap concentrate reservoirs 6*a*, 6*b* becomes depleted. The control mechanism 34 is also configured to switch supply of soap concentrate to the system 2 from one soap concentrate reservoir to the other, and vice versa.

The control mechanism 34 is coupled to sensors 36 which detect when each of the respective soap concentrate reservoirs 6*a*, 6*b* becomes depleted. This enables the control mechanism 34 to determine when the respective reservoir is empty, such that supply can be switched to the other soap concentrate reservoir.

For example, where the soap reservoir 8 is in fluid communication with the first soap concentrate reservoir 6*a*, when the control mechanism 34 determines that the first soap concentrate reservoir 6*a* is empty (i.e. has been depleted fully), the control mechanism 34 causes the switch manifold 32 to switch from the first position to the second position. When the switch manifold 32 is in the second position, the second soap concentrate reservoir 6*b* is in fluid communication with the soap reservoir 8. The soap concentrate reservoir 6*b* can then be used to supply soap concentrate to the system 2 whilst the first soap concentrate reservoir 6*a* can be replaced.

The control mechanism 34 can similarly direct the switch manifold 32 to switch between the second position and the first position, as required.

In some embodiments, the system is configured to halt replenishment of the soap reservoir 8, when both the concentrate reservoirs 6*a*, 6*b* are depleted, until at least one of the concentrate reservoirs 6*a*, 6*b* has been replaced or refilled. This ensures that the soap reservoir 8 is replenished with diluted soap of the desired concentration.

In the illustrated embodiments, the water source 4 is a mains water supply.

In use, the soap reservoir 8 contains a supply of soap. As the soap dispensers 10 are used, soap is supplied from the soap reservoir 8 to the dispensers 10 via the respective supply lines 24. Use of the dispensers 10 causes the amount of soap in the soap reservoir 8 to reduce. The soap reservoir 8 in the embodiment illustrated in FIG. 1 is of a rigid construction. Accordingly as the amount of soap in the reservoir 8 is depleted, air is permitted to enter the reservoir via an air bleed valve 38.

When the amount of soap in the soap reservoir 8 drops below a predetermined minimum level, the drop in the level of soap is detected by the second sensor 12*b*. This causes the piston operated solenoid valve 14 to be opened, thereby opening the supply line 28 from the water source 4.

When the valve 14 is opened, this enables flow of water along the supply line 28. As water flows past the venturi element 30, soap concentrate is drawn from the relevant soap concentrate reservoir (reservoir 6*a* in FIG. 1) so that diluted soap is provided to the soap reservoir 8.

This causes the amount of soap in the soap reservoir 8 to increase. Once the amount of soap has reached a predetermined maximum threshold, this is detected by the first sensor 12*a*, causing the piston operated solenoid valve 14 to be closed and replenishment of the soap reservoir 8 to be stopped.

In this way, a batch refilling mechanism for refilling the soap reservoir 8 is provided. In exemplary embodiments, the soap reservoir 8 comprises only a single sensor 12*a* to prevent overfilling of the soap reservoir. In such embodiments, filling of the soap reservoir 8 is continuous, i.e. soap is replenished continuously as it is depleted.

Replenishing of the soap reservoir 8 continues as described above until all the soap concentrate in the first soap concentrate reservoir 6*a* is used up. Sensor 36 detects when reservoir 6*a* is empty and provides this information to the control mechanism 34. Control mechanism 34 determines based on the sensor 36 feedback that the soap concentrate reservoir 6*a* is empty and causes the switch manifold 32 to be moved from the first position to the second position. This switches supply of soap concentrate from the first soap concentrate reservoir 6*a* to the second soap concentrate reservoir 6*b*, which is not empty. In other words, the second soap concentrate reservoir 6*b* is now in fluid communication with the soap reservoir 8 and so can provide soap concentrate to the system 2.

A janitor will then replace the first soap concentrate reservoir 6*a* with a full reservoir or cartridge. Alternatively the soap concentrate reservoir 6*a* may be refilled from another vessel. The second soap concentrate reservoir 6*b* will continue to provide soap concentrate to the system until it becomes empty, at which point the control mechanism will switch supply back to the first reservoir 6*a*, in a similar manner to that described above.

A janitor need only replace the relevant soap concentrate reservoir 6*a*, 6*b* when completely empty. This ensures that all the available soap concentrate is used, thereby reducing waste. There is also no requirement to refill or replace the soap reservoir 8 itself. Therefore a more simple system for ensuring continuous supply of soap is provided.

Figure 2:
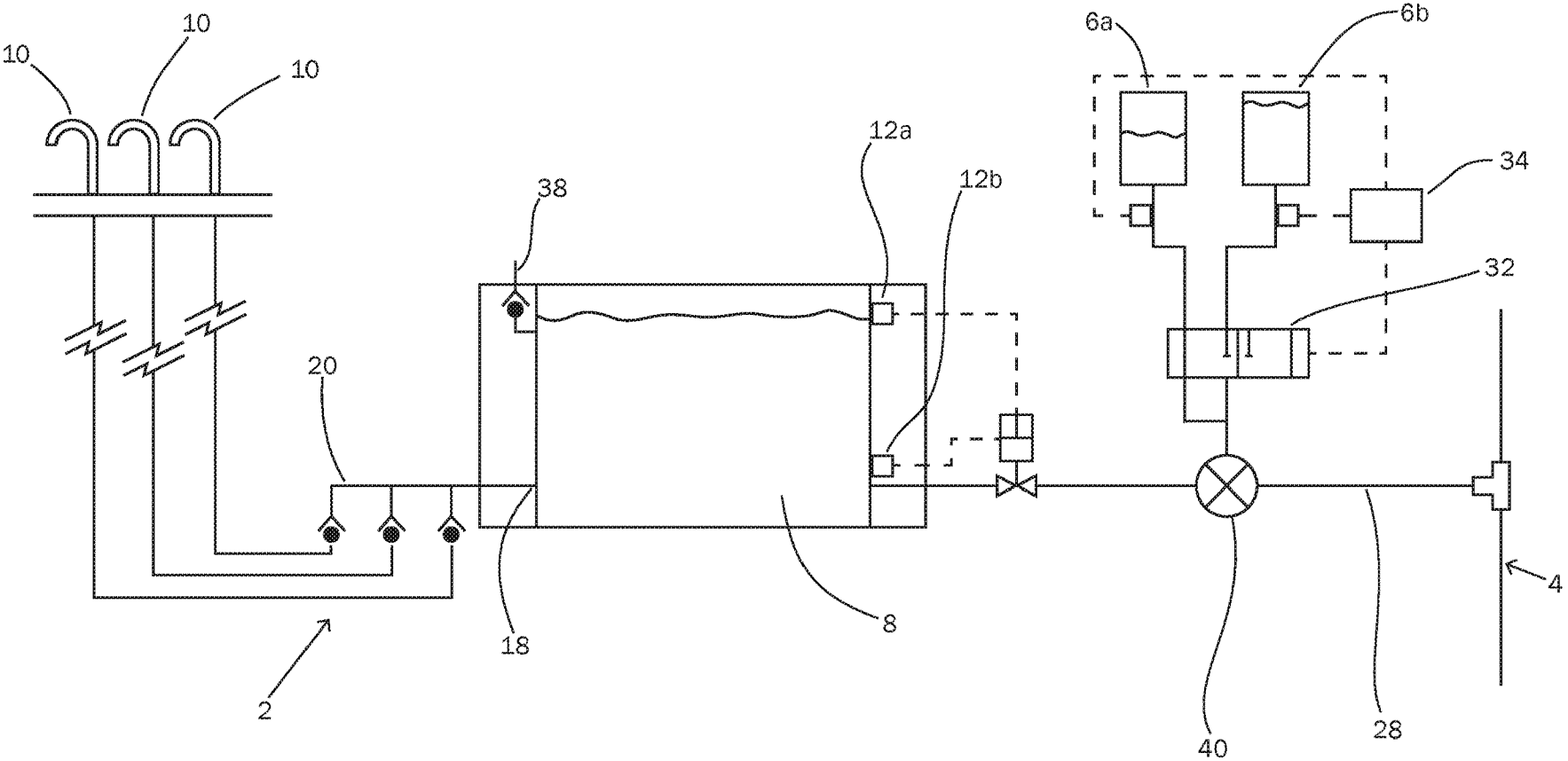
FIG. 2 is a schematic diagram of a liquid supply system in accordance with a second embodiment.

FIG. 2 illustrates a second embodiment of the disclosure. Like features will be indicated with the same reference numerals. For the sake of brevity, only those features which are different to those in the first embodiment will be described.

In the embodiment illustrated in FIG. 2, the dosing mechanism is a rotary dosing pump 40. In addition to ensuring that an appropriate amount of soap concentrate is added to the supply line 28, the rotary dosing pump 40 also acts to ensure a required flow level is provided through the supply line 28.

Figure 3:
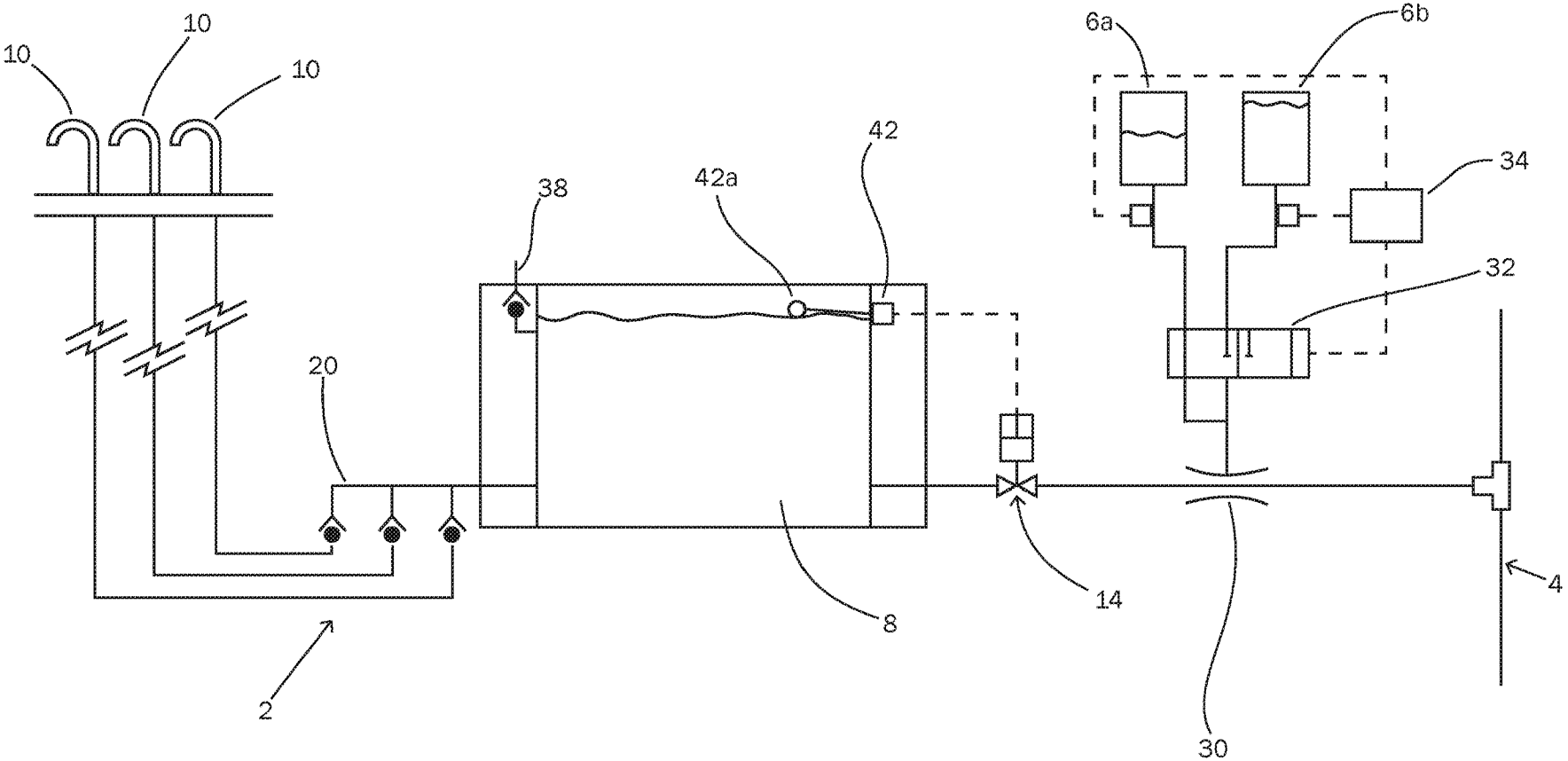
FIG. 3 is a schematic diagram of a liquid supply system in accordance with a third embodiment.

FIG. 3 illustrates a third embodiment of the disclosure. Like features are indicated with the same reference numerals. Only those features which are different from the previous embodiments will be described for the sake of brevity.

In the embodiment illustrated in FIG. 3, the soap reservoir 8 includes a float valve 42 having a float 42*a*, which floats on the surface of the soap in the soap reservoir 8.

The float valve 42 is configured to detect when the amount of soap in the soap reservoir 8 is at a predetermined maximum amount, corresponding to a predetermined position of the float 42*a*. When this is the case, the float valve 42 provides feedback to the piston operated solenoid valve 14 to cause the valve 14 to shut. This prevents further filling of the soap reservoir 8 and so prevents overfilling.

As the level of soap in the soap reservoir 8 decreases level of the float 42*a* also drops. The system is configured such that when the float 42*a* of the float valve 42 drops by a predetermined amount or angle, the float valve 44 provides feedback to the piston operated solenoid valve 14 to cause the valve to open and the soap reservoir 8 to be replenished.

Figure 4:
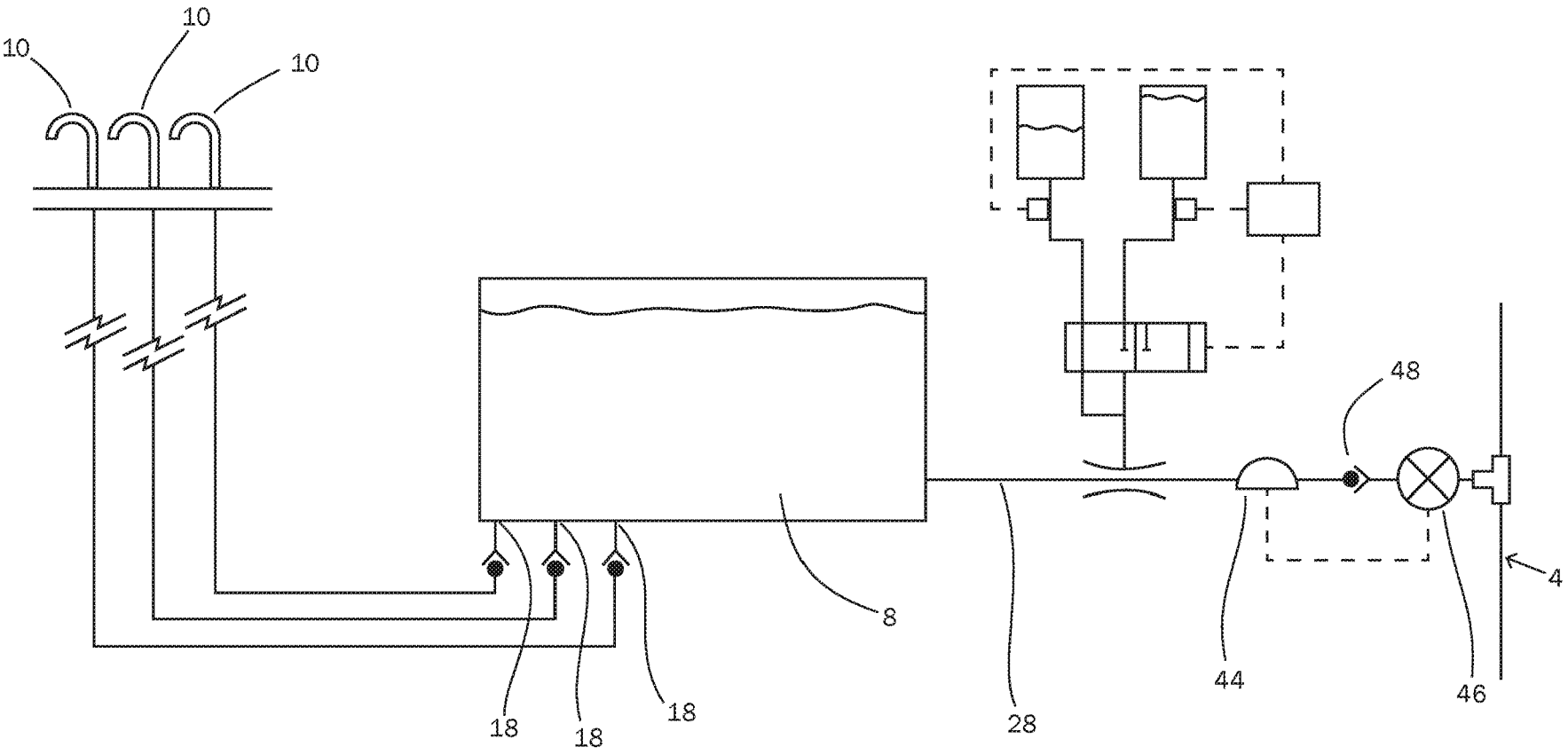
FIG. 4 is a schematic diagram of a liquid supply system in accordance with a fourth embodiment.

FIG. 4 illustrates a fourth embodiment of this disclosure. Like features are indicated by the same reference numerals. Only those features which differ from those of the previous embodiments will be described for the sake of brevity.

In this embodiment, the reservoir has three outlets 18, one for each of the soap dispensers 10. In addition, the soap reservoir 8 is a collapsible reservoir which is arranged to collapse as soap is dispensed from the reservoir. As the soap reservoir 8 is depleted, a change in pressure can be detected in the supply line 28. A pressure switch 44 is provided in the supply line 28 and is arranged to detect changes in pressure corresponding to a fill condition of the soap reservoir 8. When the soap reservoir 8 is empty or drops below a predetermined minimum amount, a corresponding pressure will be detectable in the supply line 28. This pressure is detected by the pressure switch 44 which communicates with a pump 46 to pump water through the supply line 28. This causes the soap reservoir 8 to be replenished, as previously described.

The supply line 28 also includes a non-return valve 48 to ensure that fluid in the supply line 28 does not wash back into the mains water supply 4.

As the soap reservoir 8 is refilled, a change in pressure will be detectable in the supply line 28. The pressure switch 44 is also configured to detect a pressure corresponding to when the soap reservoir 8 is completely full or has reached a predetermined maximum threshold. When this is detected, the pump 46 is directed to stop so that refilling of the soap reservoir 8 is stopped.

Since the soap reservoir 8 is collapsible, the soap supply system can be airtight, thereby improving the hygiene of the system.

In some embodiments, the pump 46 may instead be replaced by a valve e.g. a solenoid valve.

Figure 5:
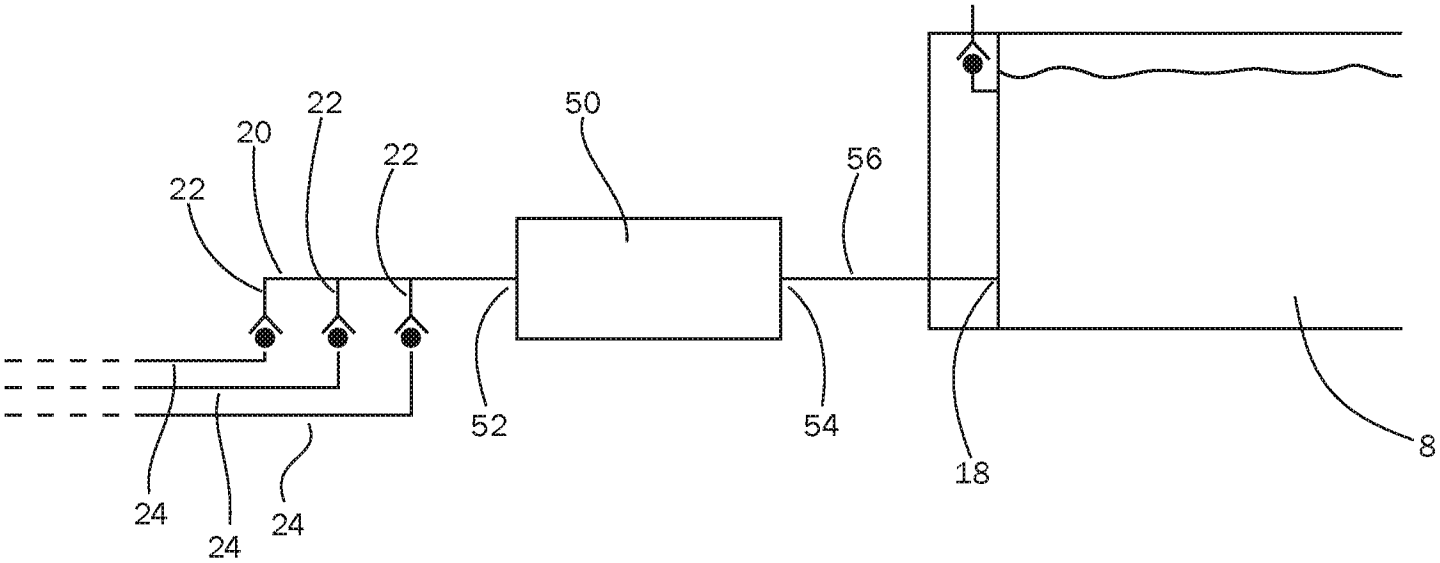
FIG. 5 is a schematic diagram of a liquid supply system in accordance with a fifth embodiment.

FIG. 5 illustrates a fifth embodiment of the disclosure. Like features are indicated by the same reference numerals. Only those features which differ from those of the previous embodiments will be described for the sake of brevity.

A header tank 50 is provided between the soap reservoir 8 and the dispensers 10. The header tank 50 has an inlet 52 and an outlet 54. The inlet 52 is coupled to the outlet 18 of the liquid reservoir 8 via a supply line 56. The outlet 54 of the header tank 50 is coupled to the series of dispensers 10 via manifold 20 and supply lines 22, 24.

The header tank 50 has a smaller volume than the soap reservoir 8 and is configured to be supplied with liquid from the liquid reservoir 8. The header tank 50 is configured to supply liquid to the or each dispenser 10 when required. For example, this may be advantageous when the soap reservoir 8 is being replenished, and/or when replenishment of the soap reservoir 8 has been halted (e.g. awaiting refill or replacement of the concentrate reservoir 6*a,b*) and the level of soap in the soap reservoir 8 is below the predetermined minimum amount.

The provision of the header tank 50 therefore ensures that, in normal use, there will always be a supply of soap available to a user.

It will be appreciated that any of the first to fourth embodiments may also include a header tank.

Figure 6:
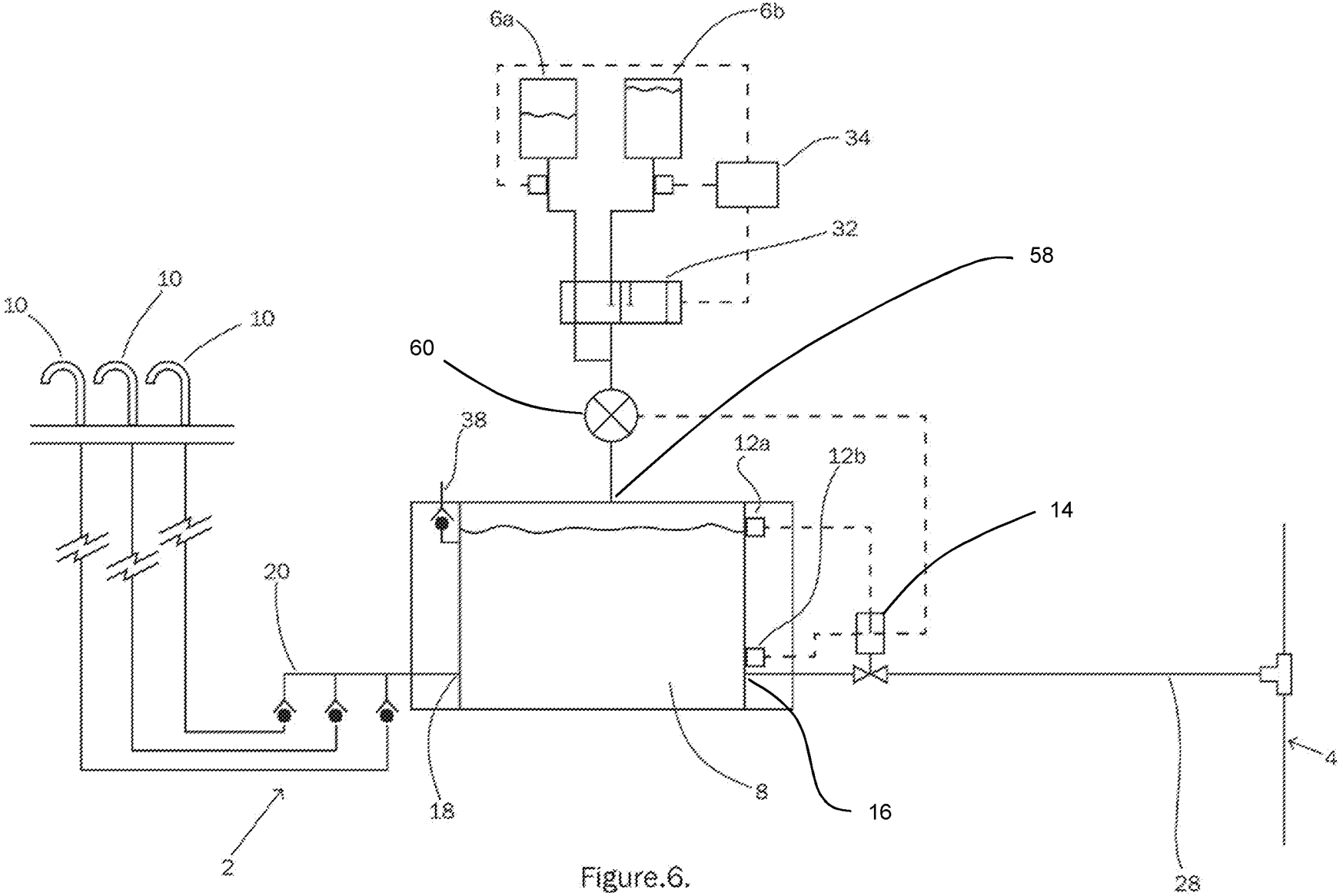
FIG. 6 is a schematic diagram of a liquid supply system in accordance with a sixth embodiment.

FIG. 6 illustrates an embodiment of the disclosure. Like features are indicated by the same reference numerals. Only those features which differ from those of the previous embodiments will be described for the sake of brevity.

The embodiment of FIG. 6 is similar to that of FIG. 2, but differs in that the dosing mechanism 30 is arranged to supply an amount of soap concentrate from the soap concentrate reservoirs 6*a*, 6*b* directly to the reservoir 8 via a dedicated inlet 58. Accordingly, the reservoir 8 has two inlets: a first water inlet 16 and a second soap concentrate inlet 58.

In such embodiments, the soap concentrate and water mix in the reservoir 8. In some embodiments, the reservoir 8 includes a mixing device e.g. a stirrer.

When the second sensor 12*b* detects that the amount of soap in the soap reservoir 8 is below the predetermined minimum amount, the piston operated solenoid valve 14 is opened to permit water flow in the supply line 28 and allow replenishing of the soap reservoir 8 with water. Additionally, the piston operated solenoid valve 14 is coupled to a concentrate pump 60 such that, when the second sensor 12*b* detects that the amount of soap in the soap reservoir 8 is below the predetermined minimum amount, a signal is passed to the concentrate pump 60 to pump an appropriate amount of soap concentrate into the reservoir 8.

The first sensor 12*a* is configured to detect when an amount of soap in the soap reservoir 8 has reached a predetermined maximum amount. In some embodiments, the first sensor 12*a* is configured to detect when the soap reservoir 8 is full.

When this predetermined maximum amount has been reached, the system 2 ceases replenishing of the soap reservoir 8. When the first sensor 12*a* detects that the amount of soap in the soap reservoir 8 has reached the predetermined maximum amount, the piston operated solenoid valve 14 closes to stop flow of water through the supply line 28 and signals to the pump 60 to stop supply of soap concentrate to the reservoir 8 from the soap concentrate reservoirs 6*a*, 6*b*, to prevent further filling of the soap reservoir 8.

In some embodiments, the fill level sensors 12*a*, 12*b* are coupled to the concentrate pump 60 directly (i.e. not via the solenoid valve 14), to trigger supply of soap concentrate to the reservoir 8.

Although the disclosure has been described above with reference to one or more embodiments, it will be appreciated that various changes or modifications may be made without departing from the scope of the invention as defined in the appended claims. For example, although the soap dispensers illustrated in the accompanying figures are counter top soap dispensers which are supplied via supply lines through the counter, wall mounted soap dispensers may also be used, or any other suitable type of soap dispenser.

Further, is will be appreciated that soap concentrate and water may be mixed prior to entering the soap reservoir, as they enter the soap reservoir, and/or in the soap reservoir.

The invention claimed is:

1. A hand soap, shampoo, hand sanitizer or lotion supply system comprising:

a water source for supplying water to the system;

a first concentrate reservoir configured to supply hand soap, shampoo, hand sanitizer or lotion concentrate to the supply system;

a second concentrate reservoir configured to supply hand soap, shampoo, hand sanitizer or lotion concentrate to the supply system, wherein the concentrate contained within the second concentrate reservoir is of the same type as that which is contained within the first concentrate reservoir;

a liquid reservoir coupled to the water source and to the first and second concentrate reservoirs, said reservoir being configured to be coupled to one or more dispensers, and wherein said reservoir is further configured to be replenished via the water source and via the first or second concentrate from either the first or second concentrate reservoir;

a switch manifold operable between a first position, in which the first concentrate reservoir is in fluid communication with the liquid reservoir and in which the second concentrate reservoir is disconnected from the liquid reservoir, and a second position, in which the second concentrate reservoir is in fluid communication with the liquid reservoir and in which the first concentrate reservoir is disconnected from the liquid reservoir; and a control mechanism configured to determine when the first or second concentrate reservoir supplying the liquid reservoir becomes depleted, and being further configured to, upon determining that the first or second concentrate reservoir supplying the liquid reservoir has become depleted, operate the switch manifold to switch the supply of concentrate to the other of the first or second concentrate reservoir.

2. The supply system according to claim 1, wherein the liquid reservoir is fixed, directly or indirectly, to the water source, and wherein the liquid reservoir is configured to be fixed, directly or indirectly, to each of the one or more liquid dispensers.

3. The supply system according to claim 1, wherein the liquid reservoir is provided in a given location in which it is configured to supply the liquid to each of the one or more liquid dispensers, and wherein the system is configured such that the liquid reservoir remains in said given location as it is replenished.

4. The supply system according to claim 1, wherein the system comprises a sensor configured to detect a fill level condition of the liquid reservoir, and wherein the system is configured to replenish the liquid reservoir in response to feedback from the sensor.

5. The supply system according to claim 4, wherein the sensor is configured to detect when the liquid reservoir is empty, when an amount of the liquid in the liquid reservoir is below a predetermined minimum fill level, when the amount of the liquid in the liquid reservoir has reached a predetermined maximum fill level, and/or when the liquid reservoir is full.

6. The supply system according to claim 4, wherein the sensor comprises a pressure sensor, a fill level switch and/or a float switch.

7. The supply system according to claim 4, wherein the sensor comprises a plurality of sensors.

8. The supply system according to claim 1, wherein the liquid reservoir comprises:

at least one inlet, via which the liquid reservoir is replenished, and at least one outlet for supplying the liquid to each of the one or more liquid dispensers.

9. The supply system according to claim 8, wherein the liquid reservoir comprises a single inlet coupled to the first and second concentrate reservoirs and to the water source.

10. The supply system according to claim 9, wherein the inlet of the liquid reservoir is coupled to the water source via a supply line, wherein the first and second concentrate reservoirs are coupled to the supply line via a dosing mechanism that is configured to supply an amount of the concentrate from the first or second concentrate reservoirs to the supply line, and wherein the dosing mechanism comprises a venturi element.

11. The supply system according to claim 9, wherein the inlet of the liquid reservoir is coupled to the water source via a supply line, wherein the first and second concentrate reservoirs are coupled to the supply line via a dosing mechanism that is configured to supply an amount of the concentrate from the first or second concentrate reservoirs to the supply line, and wherein the dosing mechanism comprises a rotary dosing pump.

12. The supply system according to claim 9, wherein the inlet of the liquid reservoir is coupled to the water source via a supply line, wherein the first and second concentrate reservoirs are coupled to the supply line via a dosing mechanism that is configured to supply an amount of the first or second concentrate from the first or second concentrate reservoir to the supply line, and wherein the supply line comprises a pump for controlling the flow through the supply line.

13. The supply system according to claim 1, wherein the water source is a mains water supply.

14. The supply system according to claim 1, wherein the liquid reservoir is collapsible.

15. The supply system according to claim 1, wherein the system is airtight.

16. The supply system according to claim 1, wherein the system is configured to replenish the liquid reservoir via batch filling or continuous filling.

17. The supply system according to claim 1, wherein the supply system further comprises:

a first sensor associated with the first concentrate reservoir, said first sensor being configured to detect when the supply of hand soap, shampoo, hand sanitizer or lotion concentrate in the first concentrate reservoir is depleted; and a second sensor associated with the second concentrate reservoir, said second sensor being configured to detect when the supply of hand soap, shampoo, hand sanitizer or lotion concentrate in the second concentrate reservoir is depleted;

wherein the control mechanism is operably coupled to the first and second sensors and is configured to determine when the first or second concentrate reservoir supplying the liquid reservoir becomes depleted based on feedback received from the sensor associated with said first or second concentrate reservoir, and wherein the control mechanism is further configured to, upon receiving said feedback, operate the switch manifold to switch the supply of concentrate to the other of the first or second concentrate reservoir.

18. The supply system according to claim 1, wherein the system includes one or more liquid dispensers coupled to the liquid reservoir.

* * * * *